US007056065B2

(12) United States Patent
Bayer

(10) Patent No.: US 7,056,065 B2
(45) Date of Patent: Jun. 6, 2006

(54) DEVICE AND METHOD FOR CHANGING LINES

(75) Inventor: Hans Joachim Bayer, Ettlingen/Oberweier (DE)

(73) Assignee: Tracto-Technik GmbH (DE)

( * ) Notice: Subject to any disclaimer, the term of this patent is extended or adjusted under 35 U.S.C. 154(b) by 0 days.

(21) Appl. No.: 10/250,355

(22) PCT Filed: Dec. 21, 2001

(86) PCT No.: PCT/EP01/15270

§ 371 (c)(1),
(2), (4) Date: Oct. 28, 2003

(87) PCT Pub. No.: WO02/053866

PCT Pub. Date: Jul. 11, 2002

(65) Prior Publication Data

US 2004/0067108 A1 Apr. 8, 2004

(30) Foreign Application Priority Data

Dec. 29, 2000 (DE) ..... 100 65 532

(51) Int. Cl.
*F16L 55/18* (2006.01)
*E21D 1/06* (2006.01)

(52) U.S. Cl. ..... 405/184.1; 405/184; 175/53; 175/62

(58) Field of Classification Search ..... 405/184, 405/184.1, 184.3; 175/53, 61, 62, 107; 138/98, 138/99

See application file for complete search history.

(56) References Cited

U.S. PATENT DOCUMENTS

| | | | | | |
|---|---|---|---|---|---|
| 2,827,264 | A | * | 3/1958 | Sitton et al. | 175/398 |
| 3,217,816 | A | * | 11/1965 | Boyer | 175/57 |
| 3,910,361 | A | * | 10/1975 | Hasewend | 175/207 |
| 4,060,141 | A | * | 11/1977 | Catterfeld | 175/94 |
| 4,117,895 | A | | 10/1978 | Ward et al. | |
| 4,519,462 | A | | 5/1985 | Kelley | |
| 4,606,700 | A | | 8/1986 | Brudny-Chelyadinov et al. | |
| 4,673,312 | A | * | 6/1987 | Nussbaumer | 405/184 |
| 4,728,259 | A | | 3/1988 | Wolfbauer et al. | |
| 5,351,764 | A | * | 10/1994 | Cherrington | 175/53 |
| 5,403,122 | A | | 4/1995 | Granella | |
| 5,695,014 | A | | 12/1997 | Jenne | |
| 5,979,573 | A | * | 11/1999 | Osadchuk | 175/108 |
| 5,979,574 | A | * | 11/1999 | Osadchuk | 175/353 |
| 6,516,902 | B1 | * | 2/2003 | Klemm | 175/61 |

FOREIGN PATENT DOCUMENTS

| | | |
|---|---|---|
| DE | 27 11 540 A1 | 12/1978 |
| DE | 39 38 749 A1 | 5/1991 |
| DE | 41 16 771 A1 | 11/1992 |
| DE | 195 04 484 C1 | 9/1996 |
| DE | 195 40 432 A1 | 5/1997 |
| EP | 0 155 990 A2 | 10/1985 |
| EP | 0 210 161 A1 | 1/1987 |
| EP | 0 703 345 A2 | 3/1996 |
| EP | 0 705 947 | 4/1996 |
| WO | WO 93/09305 | 5/1993 |
| WO | PCT/EP01/15270 | 5/2002 |
| WO | PCT/EP01/15270 | 9/2002 |
| WO | PCT/EP01/15270 | 11/2002 |

* cited by examiner

*Primary Examiner*—Jong-Suk (James) Lee
(74) *Attorney, Agent, or Firm*—Cook, Alex, McFarron, Manzo, Cummings & Mehler, Ltd.

(57) ABSTRACT

A device for replacing lines without excavation including an annular overdrilling head and a drive for rotating a front module arranged on the drilling head.

16 Claims, 4 Drawing Sheets

DEVICE AND METHOD FOR CHANGING LINES

BACKGROUND OF THE INVENTION

The invention relates to a device and a method for replacing lines without excavation, with the aid of an annular overdrilling head, which is moved over the line and is driven forward in the ground, and claims the priority of German patent application 100 65 532.7 to the content of which reference is made.

A device of the generic type is disclosed by DE 33 31 291 C2. This describes an open tubular drilling device which, for example, is placed on an underground cable and driven forward underground along the cable by the cutting force of high pressure nozzles. As a result, an annular space is produced around the cable, which facilitates or permits the removal of the cable from the ground. The device is guided by a drilling string and therefore not moved forward independently.

By contrast, DE 195 04 484 C1 discloses an open tubular drilling device which is driven through the ground by means of a linkage.

As a rule, devices of this type operate with a flushing device which comprises nozzles which are arranged on the head of the tubular forward drive element and to which flushing medium is applied.

Using the aforementioned devices, good results are achieved if no relatively large obstacles have to be overcome in the ground, rather the line to be freed is substantially free of branches, sockets or clips and, in the ground, no stones, fragments of pipe or capping stones have to be overcome.

In practice, however, the aforementioned obstacles are to be met frequently and constitute obstacles which cannot be overcome by the drilling devices described.

It is therefore an object of the invention to provide a drilling device and a drilling method which widens the field of use of known drilling devices and which is capable of overcoming specific obstacles present in the ground, which are virtually always to be expected.

The object of the invention is achieved by the subject matter of the independent claims. Advantageous refinements are the subject matter of the subclaims.

SUMMARY OF THE EMBODIMENTS

The drilling device according to the invention has a tubular drilling head (overdrilling head in the following text) and is configured in such a way that any obstacles present in the ground are separated from the pipe to be freed or the line to be freed or destroyed, by the overdrilling head carrying out a rotation, at least in its front region (front module in the following text).

The overdrilling head is preferably driven forward in the ground by a thrust linkage. In this case, it is constructed in such a way that the transition region to the linkage is characterized by a geometry which is free of weak points.

In a particularly preferred embodiment, the front module is mounted on the overdrilling head such that it can rotate and is provided with a turbine drive. In this case, a turbine rotor can be arranged on the front module, this can be followed behind by further turbine rotors arranged to run in opposite directions and a nozzle insert which is arranged on the body of the overdrilling head and which is preferably supplied via the linkage with liquid in order to drive the turbine rotors. The nozzle insert can be variable, in order to be suitable for different torque and rotational speed requirements. Furthermore, between the nozzle insert and the first turbine rotor, a steering element, for example in the form of a steering plate, can be arranged which, depending on the alignment, deflects the nozzle jet in one direction or the other and in this way effects rotation of the front module in one direction or the other. The steering plate can be constructed in such a way that it reacts to flushing surges and thus permits the direction of rotation to be changed.

The turbine is preferably constructed as a free-jet turbine, for example of the modified Pelton type, as is conventional in turbine drilling in the deep-drilling sector, or as a beveled internal gear of a gearbox element, in front of which an opposing gearwheel with attached turbine is fitted orthogonally. In the latter case, the driving force for the front module is produced by a permanently installed turbine rotor.

At the end, the overdrilling head can be fitted with tools, such as hard metal pins, hard metal plates, circular shank chisels, industrial diamonds, wear-protected welded tracks with grit, removal grooves or transverse notches for cutting or milling or severing obstacles.

The overdrilling head can, moreover, have nozzles arranged at the end for clear-flushing the ground and for cooling the drilling head. These can be formed as high pressure nozzles arranged at a specific angle.

In the following text, the invention will be explained in more detail using an exemplary embodiment illustrated in the drawing, in which:

DESCRIPTION OF THE EMBODIMENTS

Figure 1:
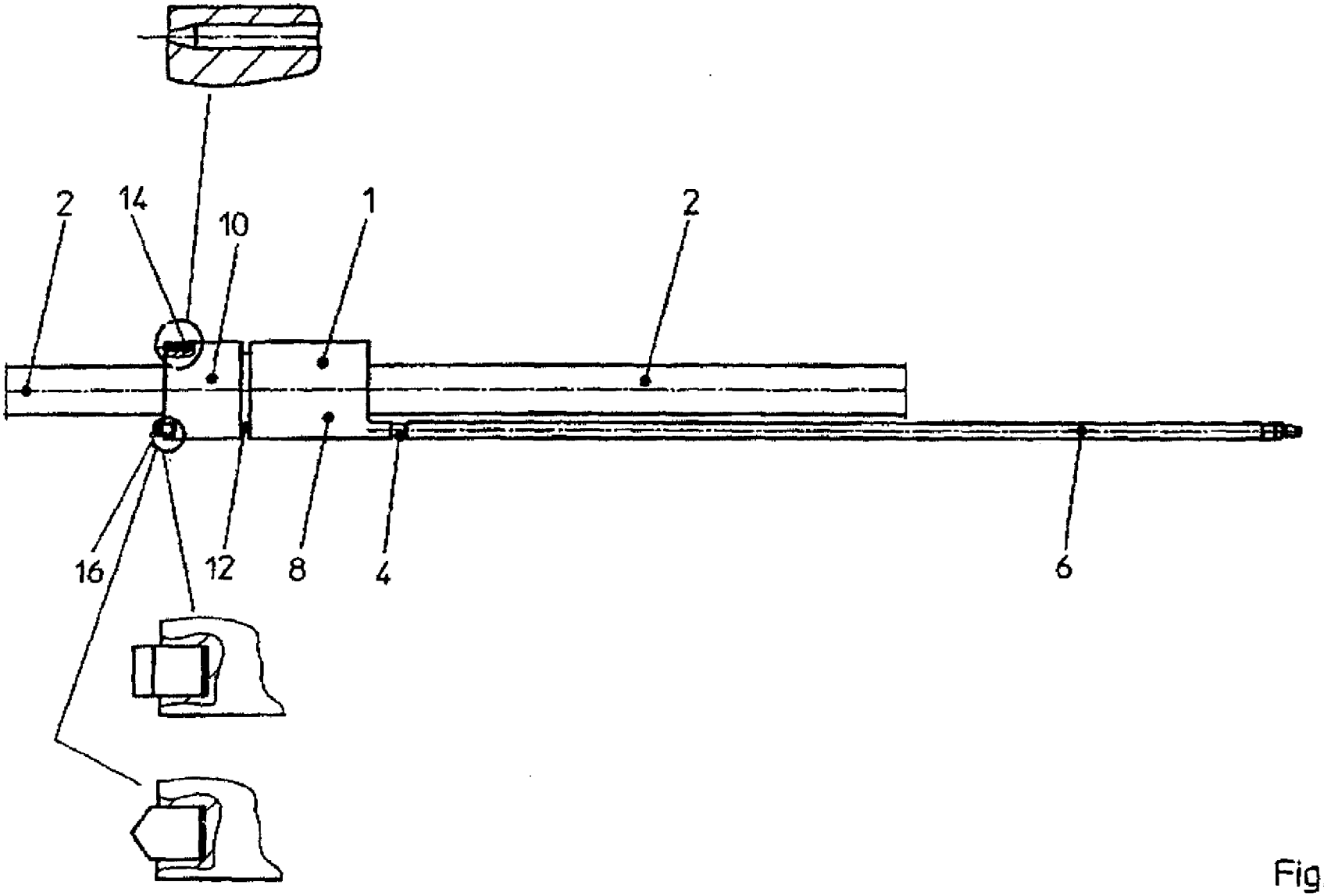
FIG. 1 shows an overdrilling head according to the invention with front module on an old line.
Figure 2:
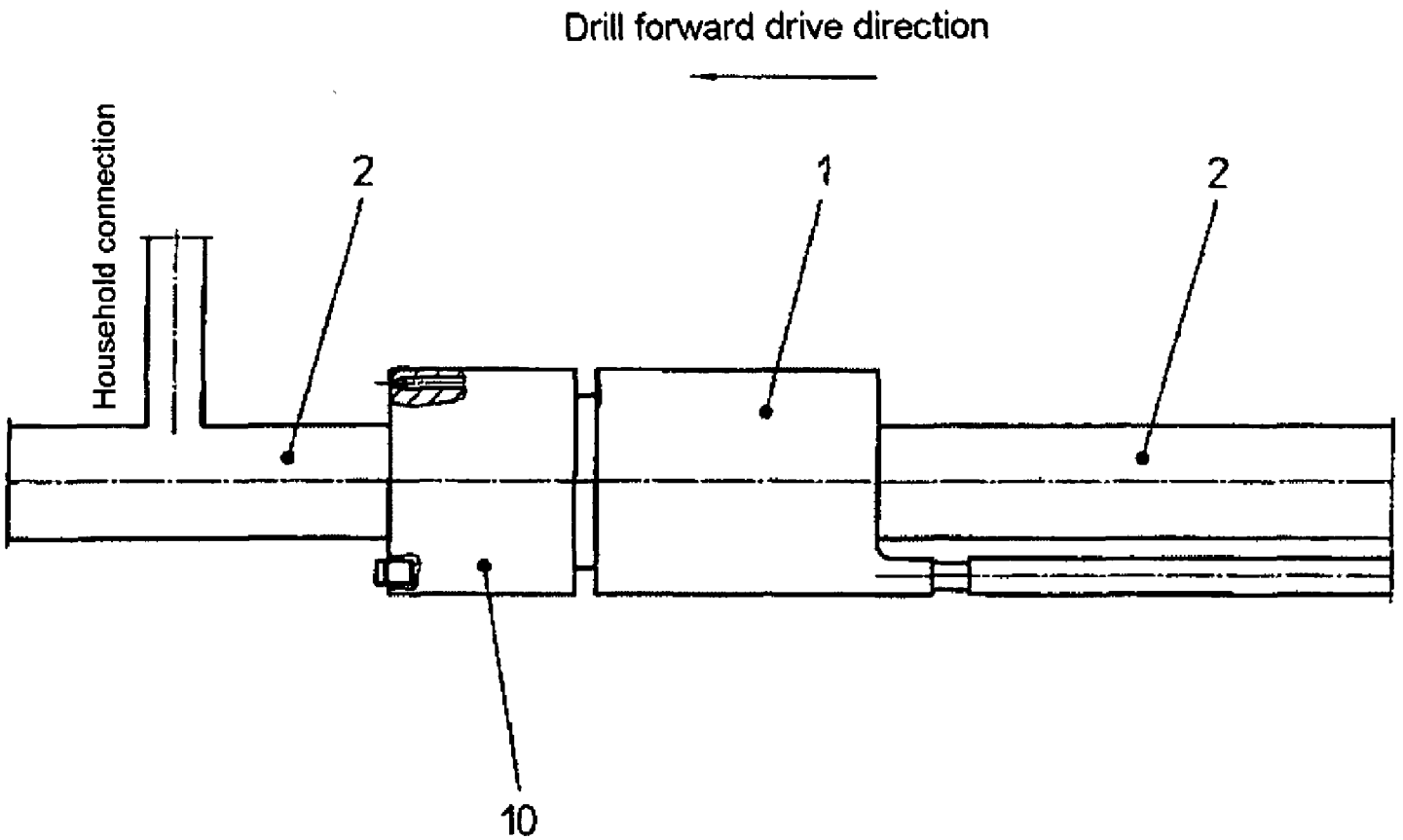
FIG. 2 shows the overdrilling head of FIG. 1 when severing a branch.
Figure 3:
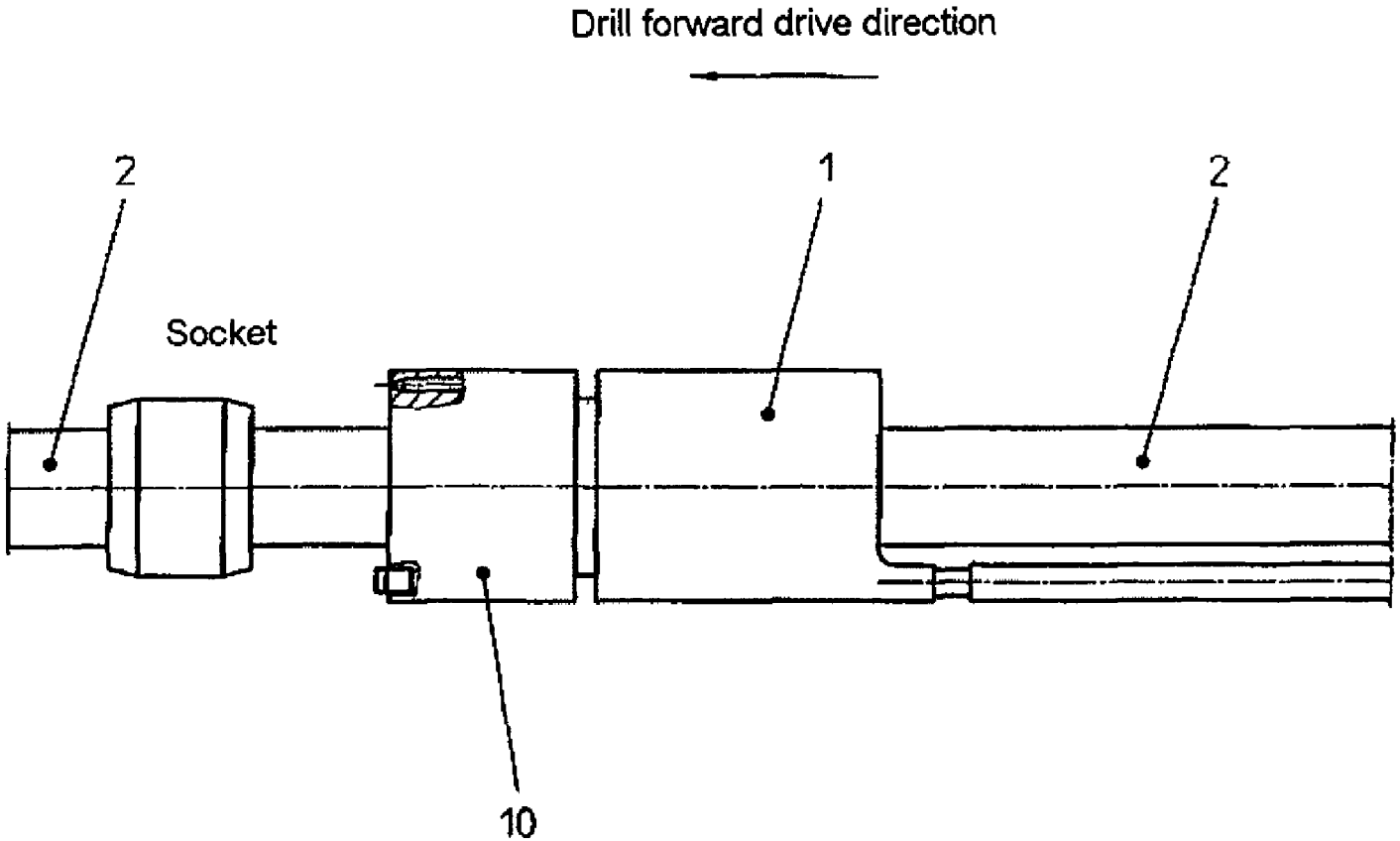
FIG. 3 shows the overdrilling head of FIG. 1 when removing a socket.
Figure 4:
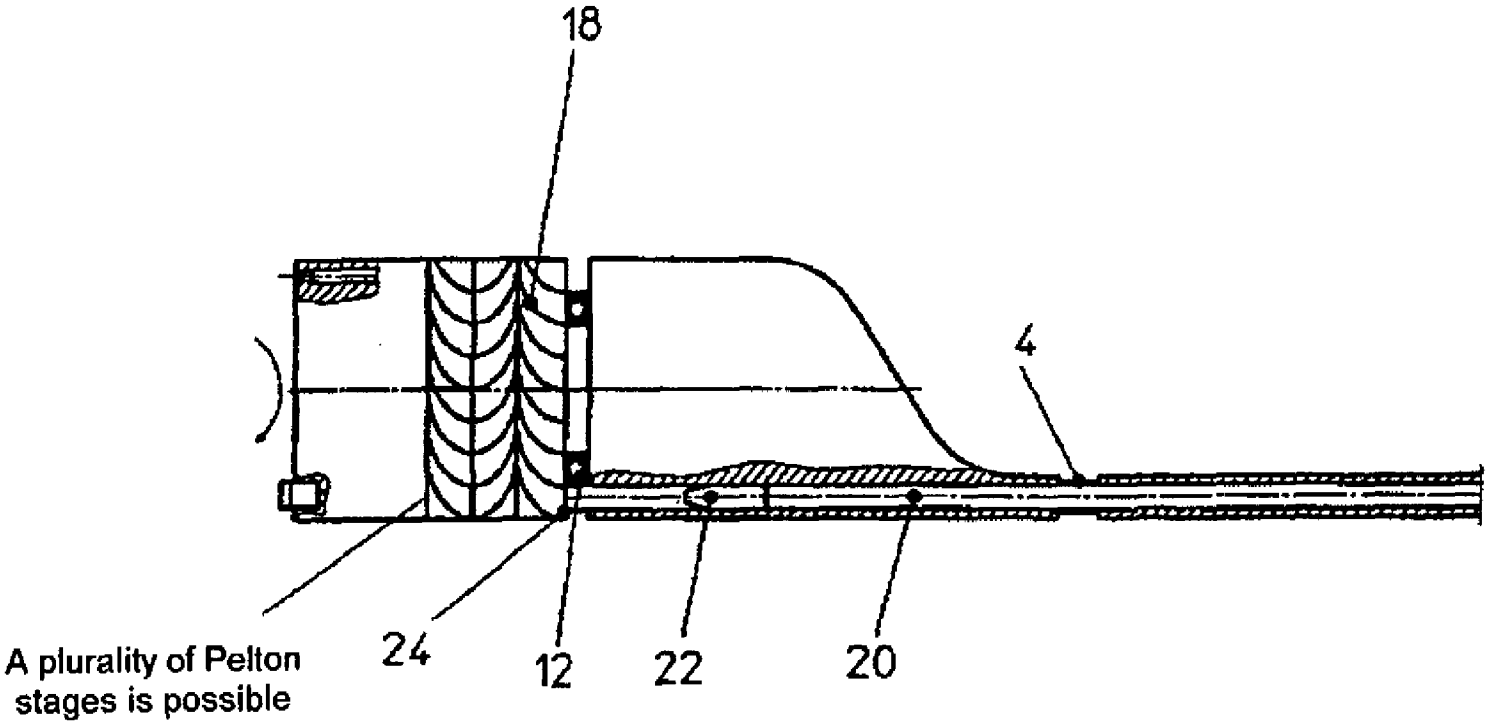
FIG. 4 shows an illustration of the drive of the front module.

In FIGS. 1 to 3, the overdrilling head 1 is illustrated on an old pipe 2 and, via a screw connection 4, is connected to a thrust linkage 6 running along the old pipe.

The overdrilling head has a body 8 and a front module 10, which is connected to the body 8 via a bearing 12 such that it can rotate. The transition between body 8 and drilling linkage 6 is characterized by a geometry that is free of weak points.

At the end, the front module 10 has high pressure nozzles 14 and/or cutting tools of hard metal or PCD with different geometries.

The front module 10 is set rotating by a drive. The drive comprises at least one free-jet turbine 18 which is arranged on the body side on the inside of the front module and behind which a plurality of turbine rotors running in opposite directions can be connected, with which a nozzle insert 22 arranged at the end of a media channel 20 running in the drilling linkage and in the body is aligned in order to form a free jet. The nozzle jet firstly strikes an adjustable steering plate 24 and then, depending on the position of the steering plate, the corresponding side of the front turbine blades of the free-jet turbine 18 in the front module.

During forward drive, the front module 10 is set rotating with the aid of the drive via the pressure medium running in the media channel 20, so that obstacles such as hose connections (see FIG. 2) or sockets (see FIG. 3) can be eliminated with the aid of the tools 16 arranged at the end of the front module 10.

The front module 10 is connected to the body 8 in an encompassing fitting means which accommodates a bearing 12.

In another embodiment, a beveled internal gear of a gearbox element is provided in the front module 10, in front of which an opposing internal gear with attached turbine is fitted orthogonally in the body 8. The first turbine rotor permanently installed in the body (or further turbine rotors) thus produces a torque which is transmitted to the front module by means of the gearbox.

The invention claimed is:

1. A device for creating an annular bore around a buried line, said device comprising an annular overdrilling head having an internal opening through which said line is guided, whereby the overdrilling head produces an annular bore around said line while being pushed along said line, said device further comprising a front module, a body and thrust linkage connection, the front module being rotatable relative to the body of the overdrilling head and a drive for the independent rotation of said front module.

2. The device as claimed in claim 1, wherein said drive for the rotation of said front module is arranged inside the overdrilling head.

3. The device as claimed in claim 1, comprising a continuous geometry, free of weak points, of the connecting region for a thrust linkage connection, which permits a uniform introduction of force into the overdrilling head.

4. The device as claimed in claim 1, wherein the overdrilling head is formed as an annular flushing head.

5. The device as claimed in claim 1, wherein the front module is rotatable by a turbine drive.

6. The device as claimed in claim 1, comprising a turbine drive comprising at least one turbine rotor and a nozzle insert aimed at said turbine rotor.

7. The device as claimed in claim 1, comprising a turbine drive comprising at least one turbine rotor with a plurality of turbine rotors running in opposite directions and a nozzle insert aimed at the first turbine rotor.

8. The device as claimed in claim 1, comprising a sequence of drilling turbine rotors running in opposite directions and belonging to turbine drilling heads for deep drilling.

9. The device as claimed claim 1, comprising a variable nozzle insert.

10. The device as claimed in claim 1, comprising a steering element arranged between a nozzle insert and a turbine rotor.

11. The device as claimed in claim 1, comprising a free-jet turbine.

12. The device as claimed in claim 1, comprising a Pelton turbine.

13. The device as claimed in claim 1, comprising an internal gear arranged on the body of the overdrilling head and belonging to a gearbox element, in front of which an opposing internal gear with attached turbine is fitted orthogonally.

14. The device as claimed in claim 1, wherein tools for severing or destroying obstacles are arranged at the end.

15. The device as claimed in claim 1, comprising a nozzle complement in the front region of the overdrilling head for clear-flushing the ground and/or cooling the drilling head.

16. A method for creating an annular bore around a buried line comprising:

pushing an annular overdrilling head onto a line, the overdrilling head comprising a front module, a body and a thrust linkage connection, guiding said line through an internal bore of said annular overdrilling head and driving said overdrilling head forward along said line, rotating the front module relative to the body of the overdrilling head, thereby creating an annular bore around said line.

* * * * *